US010800192B2

(12) United States Patent
Yamane et al.

(10) Patent No.: US 10,800,192 B2
(45) Date of Patent: Oct. 13, 2020

(54) IMAGE FORMING APPARATUS

(71) Applicant: KYOCERA Document Solutions Inc., Osaka (JP)

(72) Inventors: Naoki Yamane, Osaka (JP); Toshinori Muraoka, Osaka (JP); Satoru Nakamura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/419,228

(22) Filed: May 22, 2019

(65) Prior Publication Data

US 2019/0366748 A1 Dec. 5, 2019

(30) Foreign Application Priority Data

Jun. 1, 2018 (JP) ..... 2018-106035

(51) Int. Cl.

| | |
|---|---|
| ***B41J 29/06*** | (2006.01) |
| ***B41J 11/20*** | (2006.01) |
| ***B41J 11/14*** | (2006.01) |
| ***B41J 25/308*** | (2006.01) |

(52) U.S. Cl.

CPC ..... *B41J 29/06* (2013.01); *B41J 11/14* (2013.01); *B41J 11/20* (2013.01); *B41J 25/3088* (2013.01)

(58) Field of Classification Search

CPC ... B41J 29/06; B41J 11/20; B41J 11/14; B41J 25/3088; B41J 29/02

USPC ..... 347/104, 108

See application file for complete search history.

(56) References Cited

U.S. PATENT DOCUMENTS

| | | | | |
|---|---|---|---|---|
| 6,072,973 | A * | 6/2000 | Park | G03G 15/11 399/249 |
| 7,673,986 | B2 * | 3/2010 | Nakashima | B41J 2/16552 347/104 |
| 2008/0018726 | A1 * | 1/2008 | Moon | B05B 13/041 347/108 |

FOREIGN PATENT DOCUMENTS

JP 2012192524 A 10/2012

* cited by examiner

*Primary Examiner* — Huan H Tran
*Assistant Examiner* — Alexander D Shenderov
(74) *Attorney, Agent, or Firm* — Studebaker & Brackett PC

(57) ABSTRACT

An image forming apparatus includes a moving unit and a lifting and lowering mechanism. The moving unit is supported by a casing in an upwardly and downwardly moving manner. A fixed pully and a winding pully are provided in the casing. A movable pulley is provided in the moving unit. A wire is configured to be wound around the fixed pulley and the movable pulley. One end of the wire is fixed to the casing and the other end of the wire is fixed to the winding pulley. A rack is provided in the casing along an upper-and-lower direction. A pinion is provided in the moving unit and configured to be engaged with the rack. The winding pulley is rotated to wind and unwind the wire via the fixed pulley and the movable pulley, and the moving unit is lifted and lowered while the pinion being engaged with the rack.

6 Claims, 9 Drawing Sheets

IMAGE FORMING APPARATUS

INCORPORATION BY REFERENCE

This application is based on and claims the benefit of priority from Japanese Patent application No. 2018-106035, filed on Jun. 1, 2018, which is incorporated by reference in its entirety.

BACKGROUND

The present disclosure relates to an inkjet type image forming apparatus.

An inkjet type image forming apparatus is provided with a head unit and a conveyance unit. The head unit includes an inkjet head having a discharge opening facing downward. The conveyance unit is supported in an upwardly and downwardly movable manner in directions close to or apart from the head unit from the lower side.

As a mechanism to lift and lower a relatively heavy article, such as the conveyance unit, the following lifting and lowering mechanism is known. The lifting and lowering mechanism includes a fixed pulley and a winding pulley which are provided in a casing to which the conveyance unit is supported, a movable pulley provided in the conveyance unit, a wire both ends of which are fixed to the casing and the winding pulley, in which the wire is put around the movable pulley and the fixed pulley, and a motor to rotate the winding pulley. When the motor rotates the winding pulley, the wire is wound or unwound around the winding pulley via the fixed pulley and the movable pulley to lift and lower the conveyance unit with respect to the casing. Employing the movable pulley makes it possible to lift and lower the article with half force compared with a case employing the fixed pulley.

However, when the movable pulley is employed, in a case where it is necessary that the article be lifted and lowered while keeping a horizontal posture, it is required to lift and lower near a center of gravity of the article. In a case of the conveyance unit, because the head unit is disposed above the conveyance unit, it is impossible to dispose the movable pulley near a center portion of the conveyance unit, where is a center of gravity of the conveyance unit, in view of layout. Accordingly, it is required to dispose the movable pulley at a position where it does not interfere with the head unit and it becomes difficult to lift and lower the conveyance unit while keeping the horizontal posture.

SUMMARY

In accordance with an aspect of the present disclosure, an image forming apparatus includes a moving unit and a lifting and lowering mechanism. The moving unit is supported by a casing in an upwardly and downwardly moving manner. The lifting and lowering mechanism is configured to lift and lower the moving unit. The lifting and lowering mechanism includes a fixed pulley, a winding pulley, a movable pulley, a wire, a drive source, a rack and a pinion. The fixed pulley and the winding pulley are provided in the casing. The movable pulley is provided in the moving unit. The wire is configured to be wound around the fixed pulley and the movable pulley. One end of the wire is fixed to the casing and the other end of the wire is fixed to the winding pulley. The drive source is configured to generate driving force. The rack is provided in the casing along an upper-and-lower direction. The pinion is provided in the moving unit and configured to be engaged with the rack. When the driving force is transmitted from the drive source to the winding pulley, the winding pulley is rotated to wind and unwind the wire via the fixed pulley and the movable pulley, and the moving unit is lifted and lowered with respect to the casing while the pinion being engaged with the rack.

The above and other objects, features, and advantages of the present disclosure will become more apparent from the following description when taken in conjunction with the accompanying drawings in which a preferred embodiment of the present disclosure is shown byway of illustrative example.

DETAILED DESCRIPTION

Hereinafter, with reference to the attached drawings, an image forming apparatus according to one embodiment of the present disclosure will be described.

Figure 1:
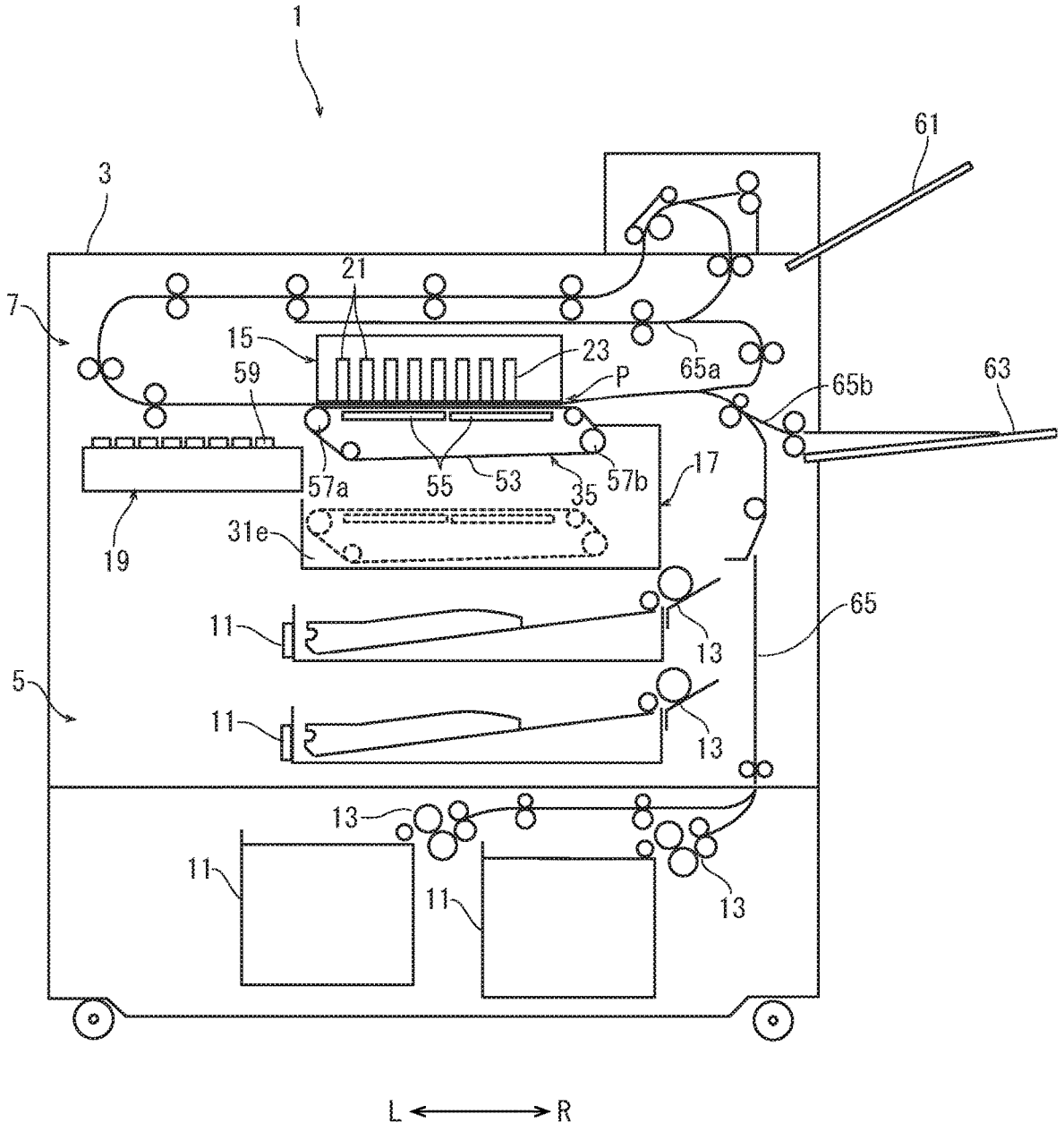
FIG. 1 is a front view schematically showing an inner structure of an image forming apparatus (at an image forming operation) according to an embodiment of the present disclosure.

With reference to FIG. 1, the image forming apparatus 1 will be described. FIG. 1 is a front view schematically showing an inner structure of the image forming apparatus (at an image forming operation). In the following description, a near side of a paper surface of FIG. 1 is defined to be a front side of the image forming apparatus 1. "Fr", "Rr", "U", "L" and "R" in each figure respectively indicate "a front side", "a rear side", "a left side" and "a right side" of the image forming apparatus.

An apparatus main body 3 of the image forming apparatus 1 is provided with a sheet feeding part 5 and an inkjet type image forming part 7. The sheet feeding part 5 is disposed in a lower portion in the apparatus main body 3, and includes a plurality of sheet feeding cassettes 11 storing sheets S and sheet feeding devices 13 feeding the sheet S from the respective sheet feeding cassettes 11. The image forming part 7 is disposed in an upper portion in the apparatus main body 3, and includes a head unit 15, a conveyance unit assembly 17 and a treatment unit 19.

The head unit 15 includes four line heads 21 corresponding to inks of four colors (yellow, magenta, cyan and black). The four line heads 21 are disposed side by side in the left-and-right direction. Each of the line heads 21 includes three inkjet heads 23. The three inkjet heads 23 are aligned in zigzag in the front-and-rear direction, and connected to ink tanks storing the corresponding inks. The inkjet head 23 has a plurality of nozzles each having a discharge opening, and piezoelectric elements provided in the respective nozzles. The nozzles are supported with the discharge openings facing downward. When applied with voltage, the piezoelectric element is deformed to push out the ink in the nozzle and to discharge it through the discharge opening.

Figure 2:
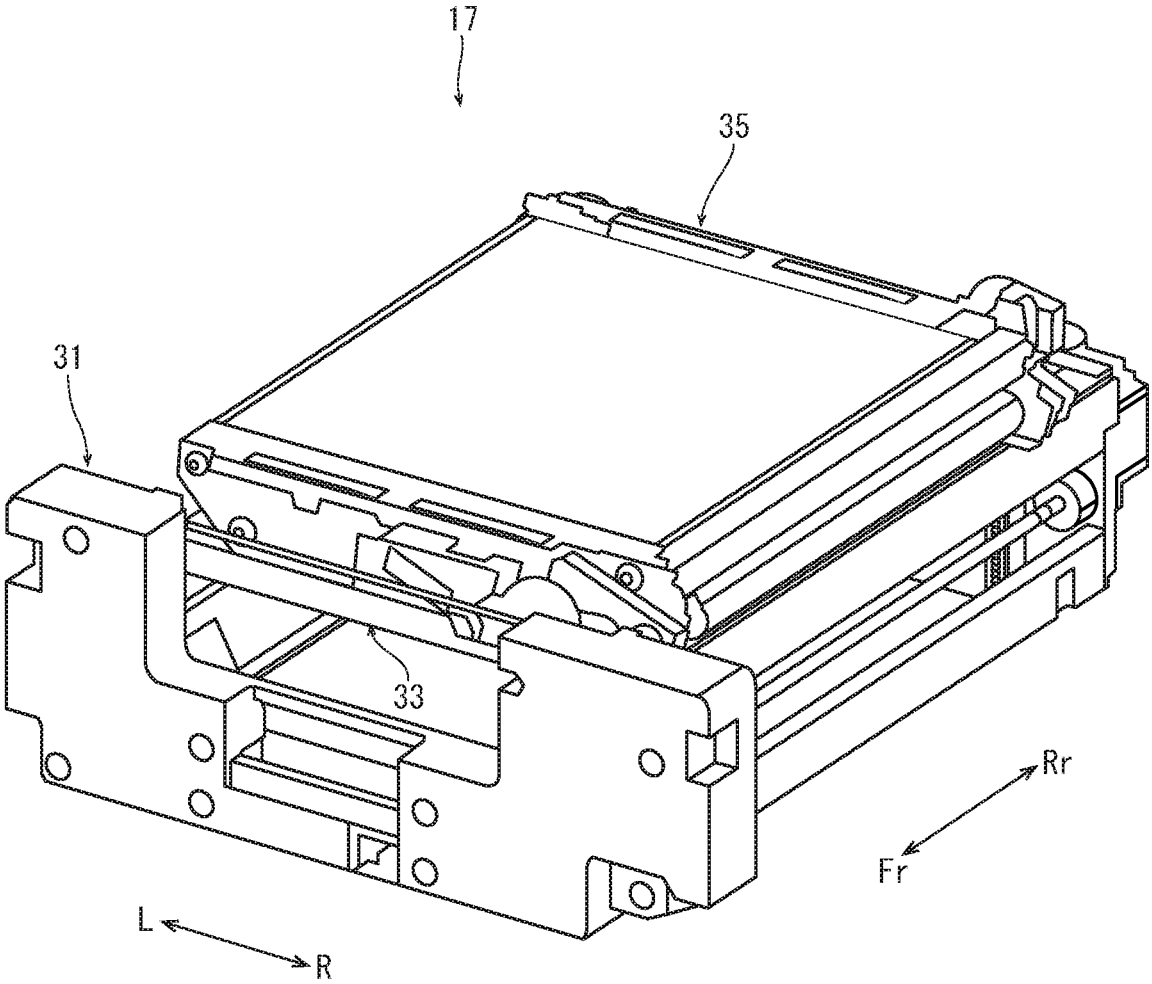
FIG. 2 is a perspective view showing a conveyance unit assembly in the image forming apparatus according to the embodiment of the present disclosure.
Figure 3:
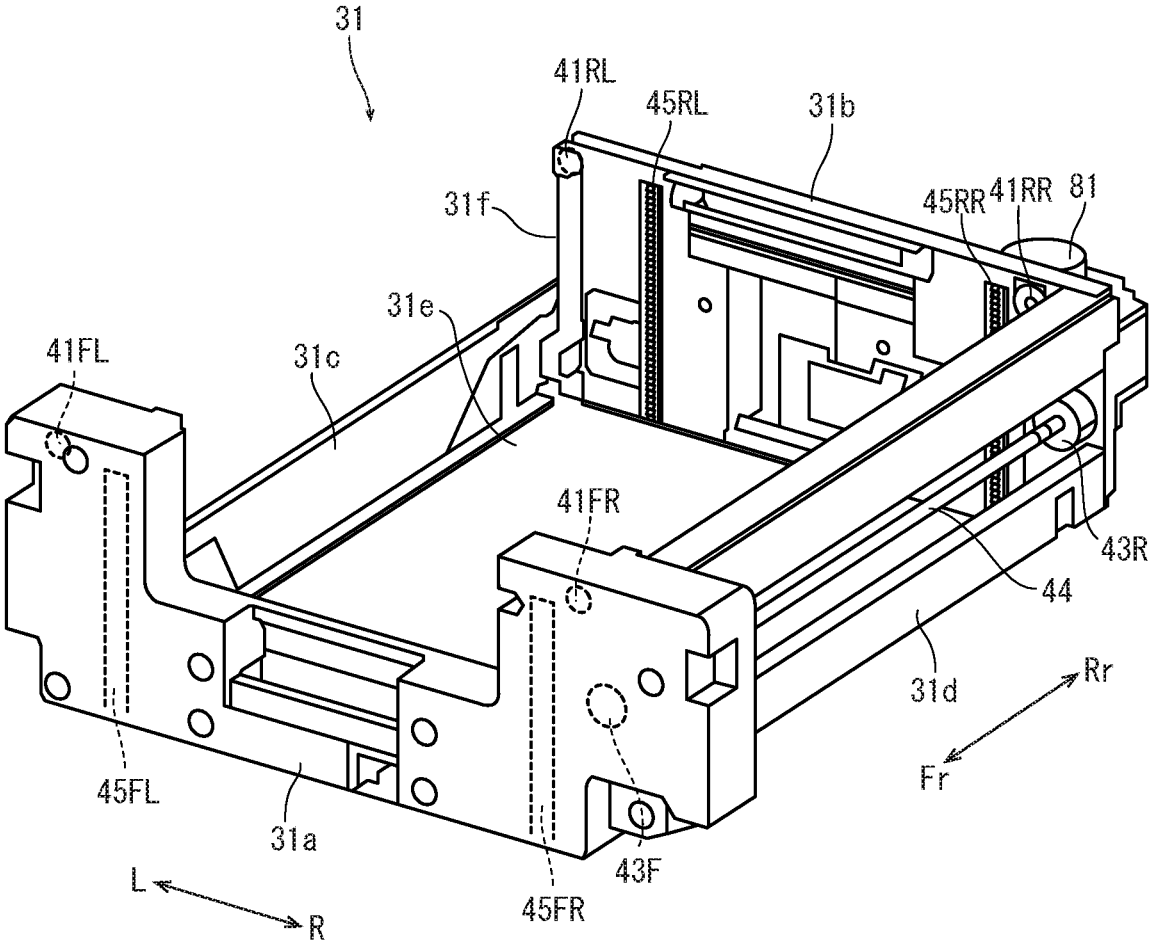
FIG. 3 is a perspective view showing a casing of the conveyance unit assembly according to a first embodiment, in the image forming apparatus according to the embodiment of the present disclosure.
Figure 4:
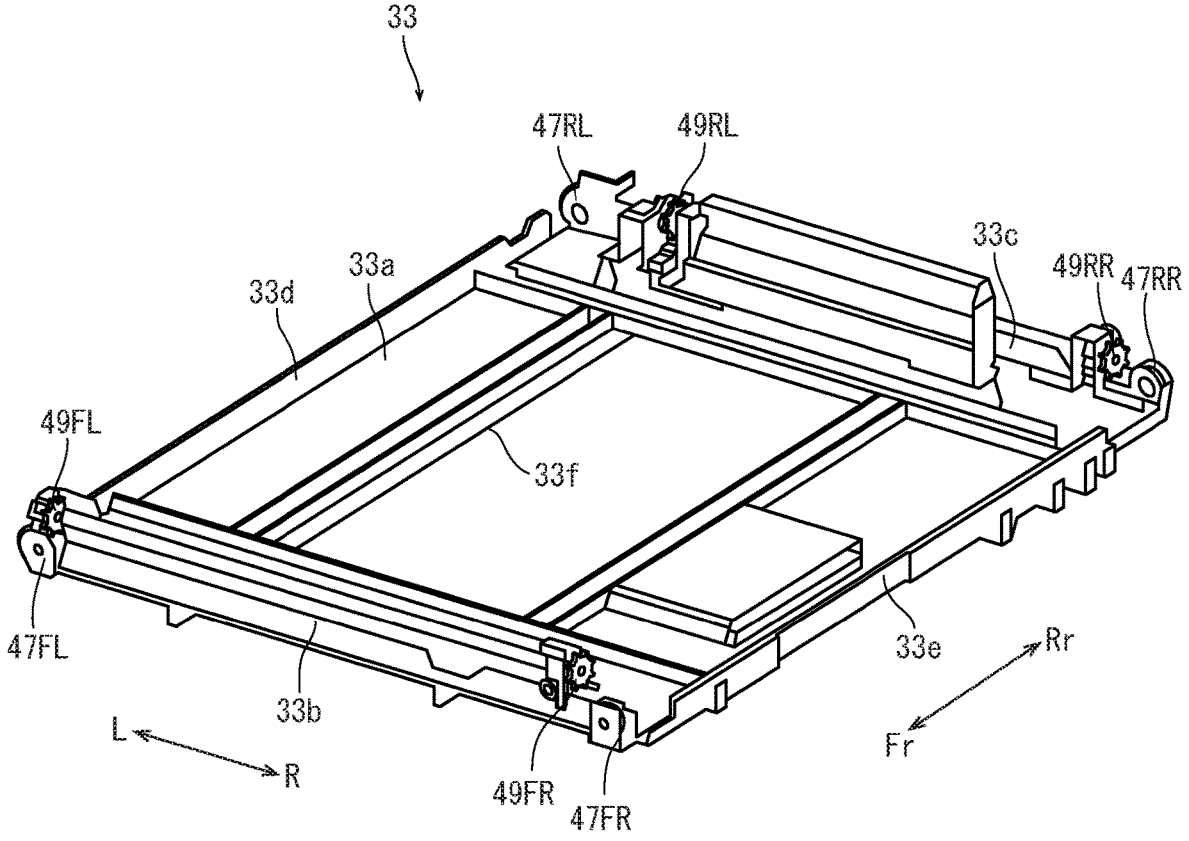
FIG. 4 is a perspective view showing a moving unit of the conveyance unit assembly according to the first embodiment, in the image forming apparatus according to the embodiment of the present disclosure.
Figure 5:
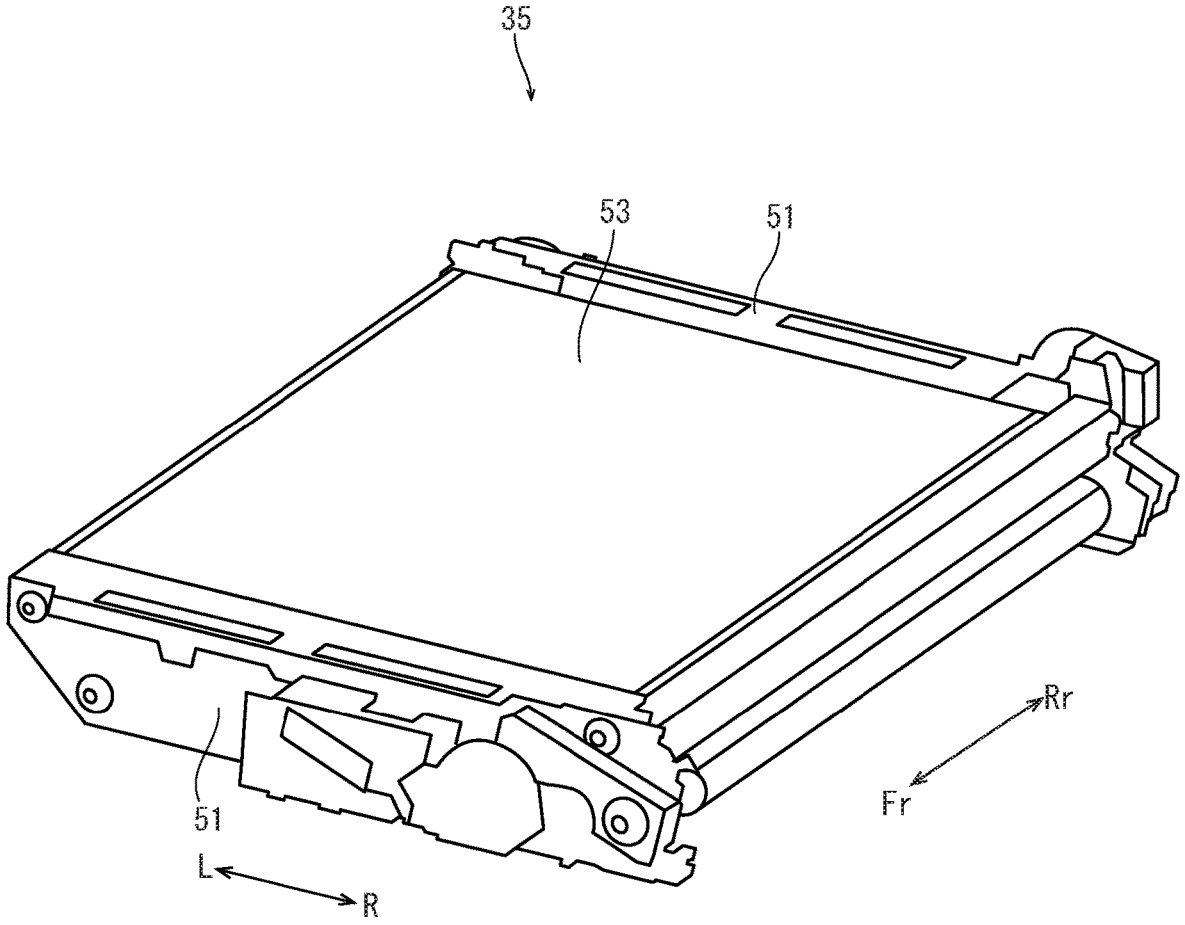
FIG. 5 is a perspective view showing a conveyance unit of the conveyance unit assembly according to the first embodiment, in the image forming apparatus according to the embodiment of the present disclosure.
Figure 6:
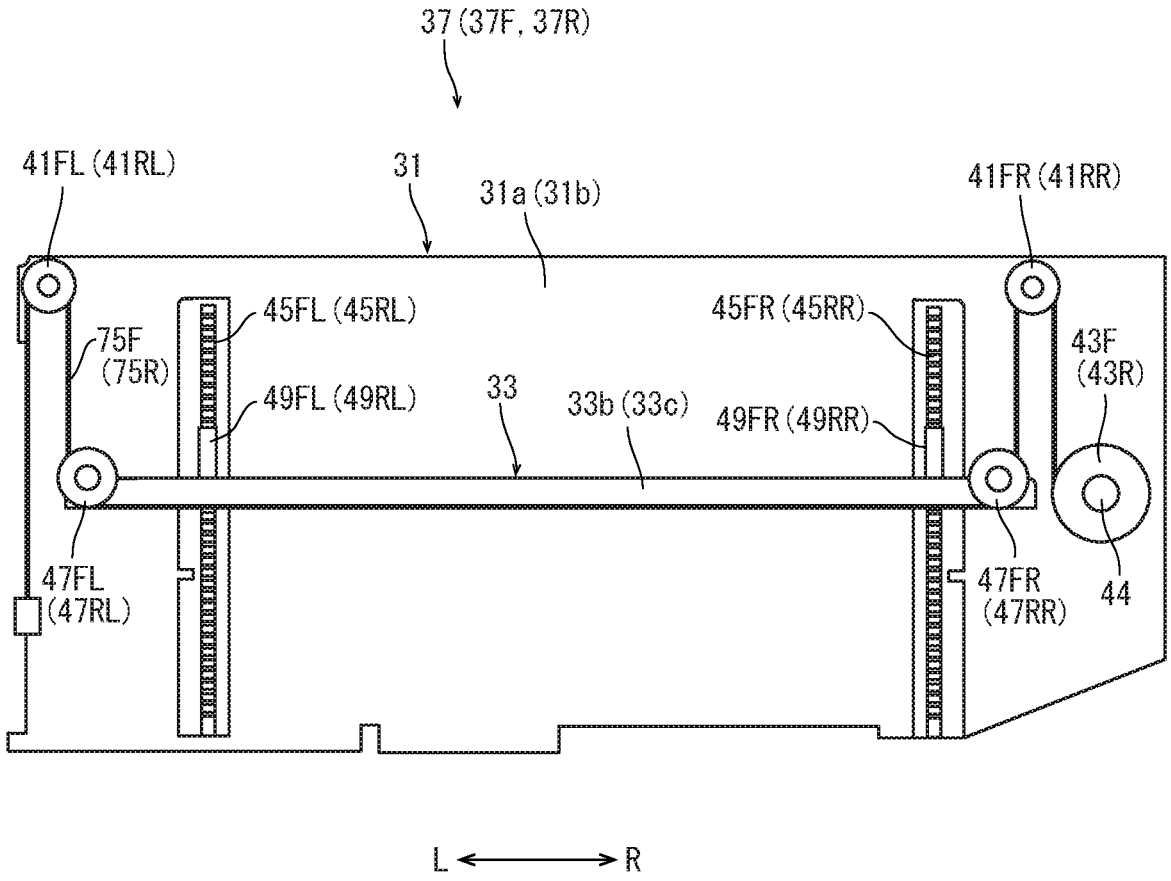
FIG. 6 is a front view schematically showing a positional relationship of each factor of a lifting and lowering mechanism of the conveyance unit assembly according to the first embodiment, in the image forming apparatus according to the embodiment of the present disclosure.
Figure 7:
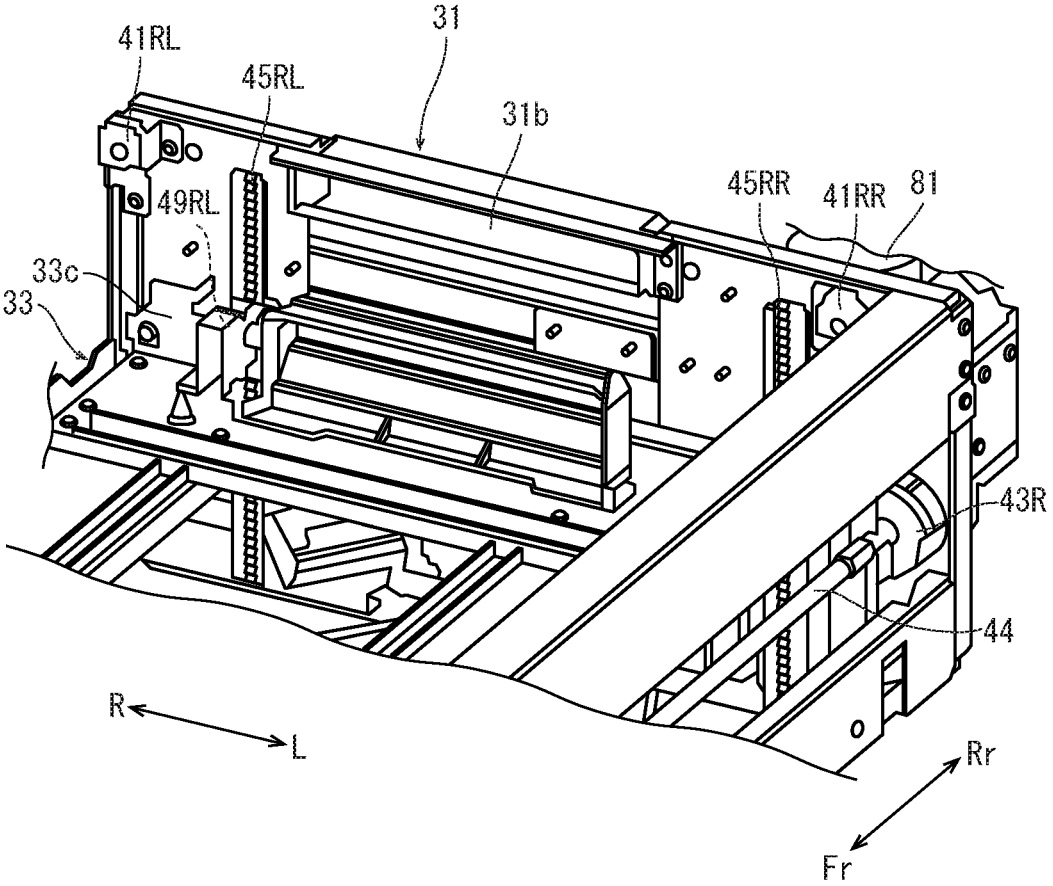
FIG. 7 is a perspective view showing a part of the casing and the moving unit of the conveyance unit assembly according to the first embodiment, in the image forming apparatus according to the embodiment of the present disclosure.

Next, a first embodiment of the conveyance unit assembly 17 will be described with reference to FIG. 1 to FIG. 7. FIG. 2 is a perspective view showing the conveyance unit assembly, FIG. 3 is a perspective view showing a casing, FIG. 4 is a perspective view showing a moving unit, FIG. 5 is a perspective view showing a conveyance unit, FIG. 6 is a front view schematically showing a positional relationship of each factor of a lifting and lowering mechanism and FIG. 7 is a perspective view showing a part of the casing and the moving unit.

As showing in FIG. 2, the conveyance unit assembly 17 includes a casing 31, a moving unit 33 supported by the casing 31 in an upwardly and downwardly moving manner, a conveyance unit 35 placed on the moving unit 33 and a lifting and lowering mechanism 37 (refer to FIG. 6) configured to lift and lower the moving unit 33 on which the conveyance unit 35 is placed. As shown in FIG. 1, the conveyance unit assembly 17 is supported by the apparatus main body 3 in an attachable and detachable manner along the front-and-rear direction below the head unit 15.

First, the casing 31 will be described with reference to FIG. 3 and FIG. 6. The casing 31 is formed by laterally long front and rear side plates 31*a* and 31*b* facing each other in the front-and-rear direction and left and right side plates 31*c* and 31*d* facing each other in the left-and-right direction, and has a storage part 31*e* having a predetermined depth. Along an upper edge of the left sideplate 31*c*, a notch 31*f* having a predetermined depth is formed.

On a rear face of the front side plate 31*a*, left and right front side fixed pulleys 41FL and 41FR are supported in a rotatable manner at the left upper corner portion and at the upper portion of the right end portion. On a front face of the rear side plate 31*b*, left and right rear side fixed pulleys 41RL and 41RR are supported in a rotatable manner at the left upper corner portion and at the upper portion of the right end portion.

On the rear face of the front side plate 31*a*, a front side winding pulley 43F is supported in a rotatable manner at the center portion in the upper-and-lower direction of the right end portion. On the front face of the rear side plate 31*b*, a rear side winding pulley 43R is supported in a rotatable manner at the center portion in the upper-and-lower direction of the right end portion. The front side winding pulley 43F and the rear side winding pulley 43R are respectively positioned outside (the right side) the right front side fixed pulley 41FR and the right rear side fixed pulley 41RR. The front and rear side winding pulleys 43F and 43R are fixed to a winding shaft 44. The winding shaft 44 is supported by the front and rear side plates 31*a* and 31*b* in a rotatable manner. A rear end portion of the winding shaft 44 penetrates rearward through the rear side plate 31*b*. To the rear end portion of the winding shaft 44, a drive gear is fixed.

A motor 81 as a drive source is supported by the rear side plate 31*b*. To an output shaft of the motor 81, an output gear is fixed. The output gear is meshed with the drive gear of the winding shaft 44 via an idle gear, a warm gear and a warm wheel. Thereby, rotating force is transmitted from the motor 81 to the winding shaft 44, and the front and rear winding pulleys 43F and 43R are rotated in one direction and in the other direction together with the winding shaft 44.

On the rear face of the front side plate 31*a*, left and right front side rack 45FL and 45FR are provided along the upper-and-lower direction at the left and right end portions. On the front face of the rear side plate 31*b*, left and right rear side rack 45RL and 45RR are provided along the upper-and-lower direction at the left and right end portions.

Next, the moving unit 33 will be described with reference to FIG. 4 and FIG. 6. The moving unit 33 is formed by a rectangular bottom plate 33*a* having a size capable of being stored in the storage part 31*e* of the casing 31, front and rear standing plates 33*b* and 33*c* bent upwardly from front and rear edges of the bottom plate 33*a*, and left and right standing plates 33*d* and 33*e* bent upwardly from left and right edges of the bottom plate 33*a*. In a center portion of the bottom plate 33*a*, a rectangular opening 33*f* is formed. The moving unit 33 is supported in the storage part 31*e* of the casing 31 in an upwardly and downwardly moving manner.

On a front face of the front standing plate 33*b*, left and right front side movable pulleys 47FL and 47FR are supported in a rotatable manner at the left and right lower corners. On a rear face of the rear standing plate 33*c*, left and right rear side movable pulleys 47RL and 47RR are supported in a rotatable manner at the left and right lower corners.

On the front face of the front standing plate 33*b*, left and right front side pinions 49FL and 49FR are supported in a rotatable manner around an axis along the left-and-right direction, at the left and right end portions. On the rear face of the rear standing plate 33*c*, left and right rear side pinions 49RL and 49RR are supported in a rotatable manner around an axis along the left-and-right direction, at the left and right end portions. The left and right front side pinions 49FL and 49FR are positioned inside (at a center side in the left-and-right direction of the moving unit 33) of the left and right front side movable pulleys 47FL and 47FR. The left and right rear side pinions 49RL and 49RR are positioned inside (at the center side in the left-and-right direction of the moving unit 33) of the left and right rear side movable pulleys 47RL and 47RR.

As shown in FIG. 6 and FIG. 7, the left and right front side pinions 49FL and 49FR are engageable with the left and right front side racks 45FL and 45FR. The left and right rear side pinions 49RL and 49RR are engageable with the left and right rear side racks 45RL and 45RR.

Next, the conveyance unit 35 will be described with reference to FIG. 5. The conveyance unit 35 includes a pair of front and rear side plates 51, a conveyance belt 53 configured to be circulated and a suction device 55 (refer to FIG. 1). Between left end portions and right end portions of the front and rear side plates 51, a drive roller 57*a* and a driven roller 57*b* are supported in a rotatable manner (refer to FIG. 1). The drive roller 57*a* is driven by a motor (not shown) to be rotated. The conveyance belt 53 is wound around the drive roller 57*a* and the driven roller 57*b*. When the drive roller 57*a* is driven by the motor to be rotated, the conveyance belt 53 is circulated in the counterclockwise direction in FIG. 1 and FIG. 5. An upper side track of the conveyance belt 53 is formed along the horizontal direction, and travels from the right side to the left side in FIG. 1 and FIG. 5. As shown in FIG. 1, the suction device 55 is disposed in a hollow space of the conveyance belt 53, and faces the upper side track of the conveyance belt 53. The suction device 55 generates a negative pressure in a space above the upper side track of the conveyance belt 53.

The conveyance unit 35 is placed on the bottom plate 33*a* of the moving unit 33. When the moving unit 33 is lifted by the lifting and lowering mechanism 37 (refer to a solid line in FIG. 1), the upper side track of the conveyance belt 53 of the conveyance unit 35 placed on the moving unit 33 is close to the discharge openings of the inkjet heads 23 of the head unit 15 to form an image forming path P (refer to FIG. 1) between the upper side track of the conveyance belt 53 and the discharge openings of the inkjet heads 23. On the other hand, when the moving unit 33 is lowered by the lifting and lowering mechanism 37 (refer to a chain line in FIG. 1), a predetermined space is formed between the conveyance unit 35 and the head unit 15.

As shown in FIG. 1, the treatment unit 19 includes caps 59 corresponding to the inkjet heads 23 of the head unit 15. The cap 59 has an oval cylindrical shape having a size larger than that of the inkjet head 23.

The treatment unit 19 is supported in a movable manner along the left-and-right direction between a treatment position below the head unit 15 and a retracting position at the left side of the treatment position. At the treatment position, the caps 59 face the corresponding inkjet heads 23 of the head unit 15. The treatment unit 19 moves between the treatment position and the retracting position through the notch 31*f* of the left side plate 31*c* of the casing 31 of the conveyance unit assembly 17.

With reference to FIG. 1, on a right side face of the apparatus main body 3, a discharge tray 61 and a manual bypass tray 63 are provided. The discharge tray 61 is disposed in an upper end portion of the right side face and the manual bypass tray 63 is disposed below the discharge tray 61.

Inside the apparatus main body 3, a conveyance path 65 for the sheet S is formed. The conveyance path 65 is formed from the sheet feeding devices 13 of the sheet feeding part 5 to the discharge tray 61 through the image forming path P. The conveyance path 65 has a switchback path 65*a* branched from a downstream side of the image forming path P and joined to an upstream side of the image forming path P in the conveyance direction. To the conveyance path 65, a manual bypass path 65*b* extending from the manual bypass tray 63 is joined at an upstream side of the joined portion of the switchback path 65*a* to the conveyance path 65.

Next, the image forming operation will be described. At the image forming operation shown in FIG. 1, the conveyance unit 35 is lifted, and the image forming path P is formed between the upper side track of the conveyance belt 53 and the discharge openings of the inkjet heads 23. The treatment unit 19 is moved to the retracting position.

First, the sheet is fed from the predetermined sheet feeding cassette 11 to the conveyance path 65 by the sheet feeding device 13. The fed sheet is conveyed to the image forming path P along the conveyance path 65. In the image forming path P, the suction device 55 of the conveyance unit 35 generates the negative pressure in the space above the upper sidetrack of the conveyance belt 53, and the sheet is conveyed while being sucked to the conveyance belt 53. Then, the ink is discharged from the discharge openings corresponding to an image data to form an image on the sheet. The sheet on which the image is formed is conveyed along the conveyance path 65 and then discharged on the discharge tray 61. When a duplex printing is performed, the sheet on one face of which the image is formed is conveyed to the switchback path 65*a* and is turned upside down. Then, after the image is formed on the other face of the sheet, the sheet is conveyed along the conveyance path 65 and then discharged on the discharge tray 61.

After the image forming operation is finished, the conveyance unit 35 is lowered and the treatment unit 19 is moved to the treatment position. Then, the treatment unit 19 is lifted and the inkjet heads 23 of the head unit 15 are covered with the corresponding caps 59 to prevent drying of the discharge openings of the nozzles.

Next, the lifting and lowering mechanism 37 will be described with reference to FIG. 6. The lifting and lowering mechanism 37 is constituted by a front side lifting and lowering mechanism 37F, a rear side lifting and lowering mechanism 37R and the four pinions 49FL, 49FR, 49RL and 49RR respectively engageable with the four racks 45FL, 45FR, 45RL and 45RR.

The front side lifting and lowering mechanism 37F is constituted by a front side wire 75F, the left front side fixed pulley 41FL, the left and right front side movable pulleys 47FL and 47FR, the right front side fixed pulley 41FR and the front side winding pulley 43F. One end of the front side wire 75F is fixed to the left lower corner of the rear face of the front side plate 31*a* of the casing 31. The other end of the front side wire 75F is fixed to the front side winding pulley 43F. The front side wire 75F is wound around the left front side fixed pulley 41FL, the left and right front side movable pulleys 47FL and 47FR and the right front side fixed pulley 41FR in the order from the one end to the other end.

The rear side lifting and lowering mechanism 37R is constituted by a rear side wire 75R, the left rear side fixed pulley 41RL, the left and right rear side movable pulleys 47RL and 47RR, the right rear side fixed pulley 41RR and the front side winding pulley 43R. One end of the rear side wire 75R is fixed to the left lower corner of the front face of the rear side plate 31*b* of the casing 31. The other end of the rear side wire 75R is fixed to the rear side winding pulley 43R. The rear side wire 75R is wound around the left rear side fixed pulley 41RL, the left and right rear side movable pulleys 47RL and 47RR and the right rear side fixed pulley 41RR in the order from the one end to the other end.

When the winding shaft 44 is rotated in one direction and the other direction, the front and rear side wires 75F and 75R are wound or unwound around the front and rear side winding pulleys 43F and 43R via the fixed pulleys and the movable pulleys, and the moving unit 33 is lifted and lowered with respect to the casing 31.

In the image forming apparatus 1 having the above configuration, a lifting and lowering operation of the moving unit 33 (the conveyance unit 35) by the lifting and lowering mechanism 37 will be described with reference to FIG. 6 and the others.

When the moving unit 33 is lifted, the motor 81 is driven to rotate the output shaft in the one direction. The rotation of the output shaft is transmitted to the drive gear of the winding shaft 44 via the idle gear, the warm gear and the warm wheel to rotate the drive gear. Thereby, the winding shaft 44 is rotated in the one direction, and the front and rear side wires 75F and 75R are wound around the front and rear side winding pulleys 43F and 43R via the movable pulleys of the moving unit 33 and the fixed pulleys of the casing 31. Then, the moving unit 33 is lifted. At this time, the moving unit 33 is lifted while the four pinions 49FL, 49FR, 49RL and 49RR being engaged with the four racks 45FL, 45FR, 45RL and 45RR so that its horizontal posture is kept. When the moving unit 33 is lowered, the motor 81 is driven to rotate the output shaft in the other direction. At the lowering operation, the moving unit 33 is lowered while the four pinions 49FL, 49FR, 49RL and 49RR being engaged with the four racks 45FL, 45FR, 45RL and 45RR so that its horizontal posture is kept.

As described above, according to the image forming apparatus 1 of the present disclosure, the lifting and lowering mechanism 37 supports the moving unit 33 at positions other than its center of gravity (that is, at near four corners of the moving unit 33). However, the moving unit 33 is lifted and lowered with respect to the casing 31 while the four pinions 49FL, 49FR, 49RL and 49RR being engaged with the four racks 45FL, 45FR, 45RL and 45RR so that the moving unit 33 is kept at the horizontal posture during the lifting and the lowering. That is, even if the article, such as the moving unit 33, is supported at positions other than its center of gravity and lifted or lowered, it becomes possible to lift and lower the moving unit 33 with the horizontal posture. Accordingly, a positional relationship between the moving unit 33 and the casing 31 is kept at constant so that it becomes possible to lift and lower the moving unit 33 stably.

In the present embodiment, the four pinions and four racks are provided; however, a number of the pinions and the racks is not limited thereto.

Figure 8:
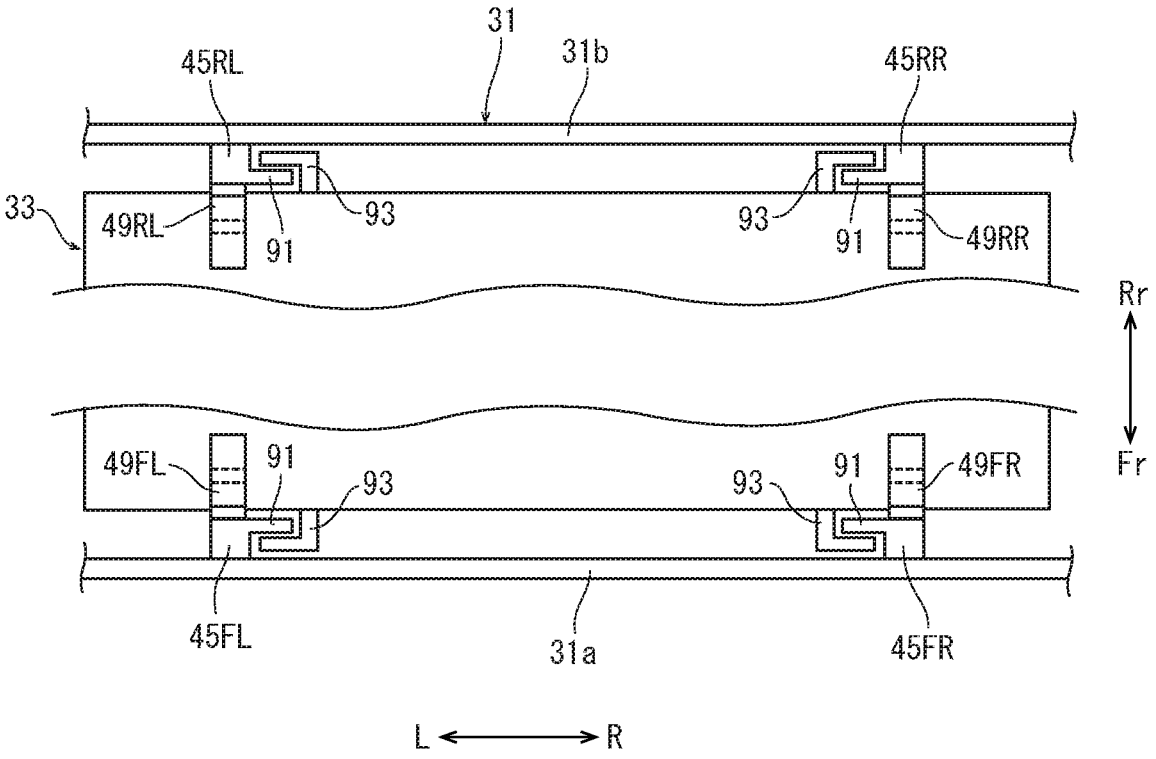
FIG. 8 is a plan view showing a modified example of the conveyance unit assembly according to the first embodiment, in the image forming apparatus according to the embodiment of the present disclosure.

Next, with reference to FIG. 8, a modified example of the first embodiment will be described. FIG. 8 is a plan view schematically showing an engagement piece and an engagement pin of the casing.

The left and right front side racks 45FL and 45FR and the left and right rear side racks 45RL and 45RR are each provided with an engagement piece 91 along the upper-and-lower direction. The engagement piece 91 protrudes from each rack inwardly (in a direction toward the center side in the left-and-right direction of the moving unit 33) via a gap with respect to the front side plate 31*a* or the rear side plate 31*b*.

On the other hand, on the front face of the front standing plate 33*b* and the rear face of the rear standing plate 33*c* of the moving unit 33, an engagement pin 93 engageable with each engagement piece 91 is fixed. The engagement pin 93 has a base portion along the front-and-rear direction and a bent portion bent almost at a right angle from a tip end of the base portion outwardly (outside in the left-and-right direction of the moving unit 33). The bent portion of each engagement pin 93 is inserted into the gap between each engagement piece 91 and the front side plate 31*a* or the rear side plate 31*b*. Thereby, the engagement piece 91 is engaged with the engagement pin 93 in the front-and-rear direction.

In the modified example, the engagement piece 91 of each rack fixed to the casing 31 is engaged with the engagement pin 93 fixed to the moving unit 33 in the front-and-rear direction so that the moving unit 33 is restricted from being displaced in the front-and-rear direction. Accordingly, it becomes possible to lift and lower the moving unit 33 stably. Meanwhile, it is possible that the engagement of the rack with the pinion restricts mechanical play in the front-and-rear direction. However, a dimensional tolerance between the pinion and the rack in the front-and-rear direction is relatively large, and it becomes difficult to restrict the mechanical play in the front-and-rear direction by the engagement of the rack with the pinion only.

Figure 9A:
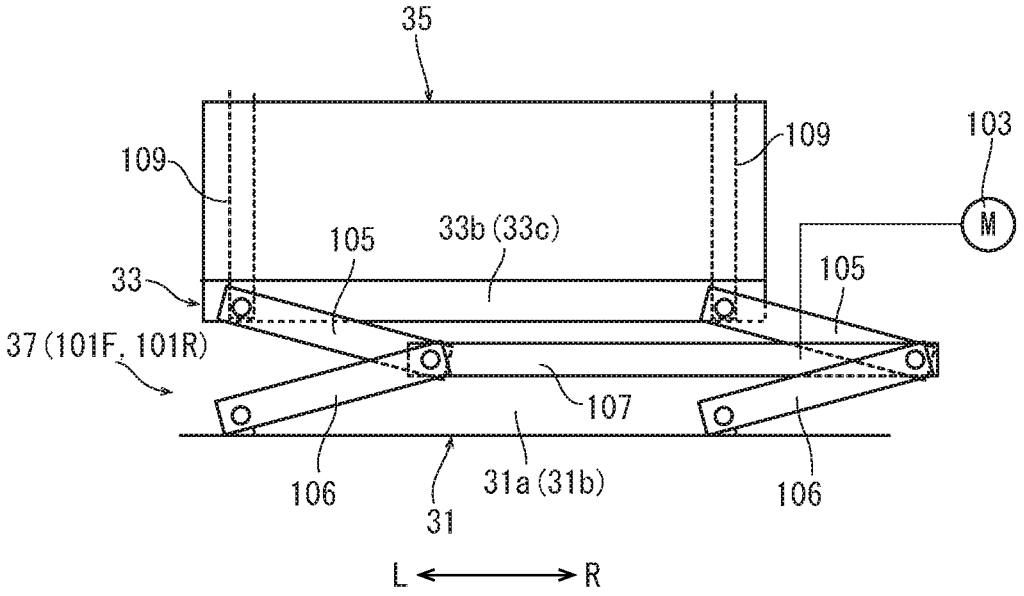
FIG. 9A is a front view schematically showing a positional relationship of each factor of the lifting and lowering mechanism of the conveyance unit assembly (when the moving unit is lowered) according to a second embodiment, in the image forming apparatus according to the embodiment of the present disclosure.
Figure 9B:
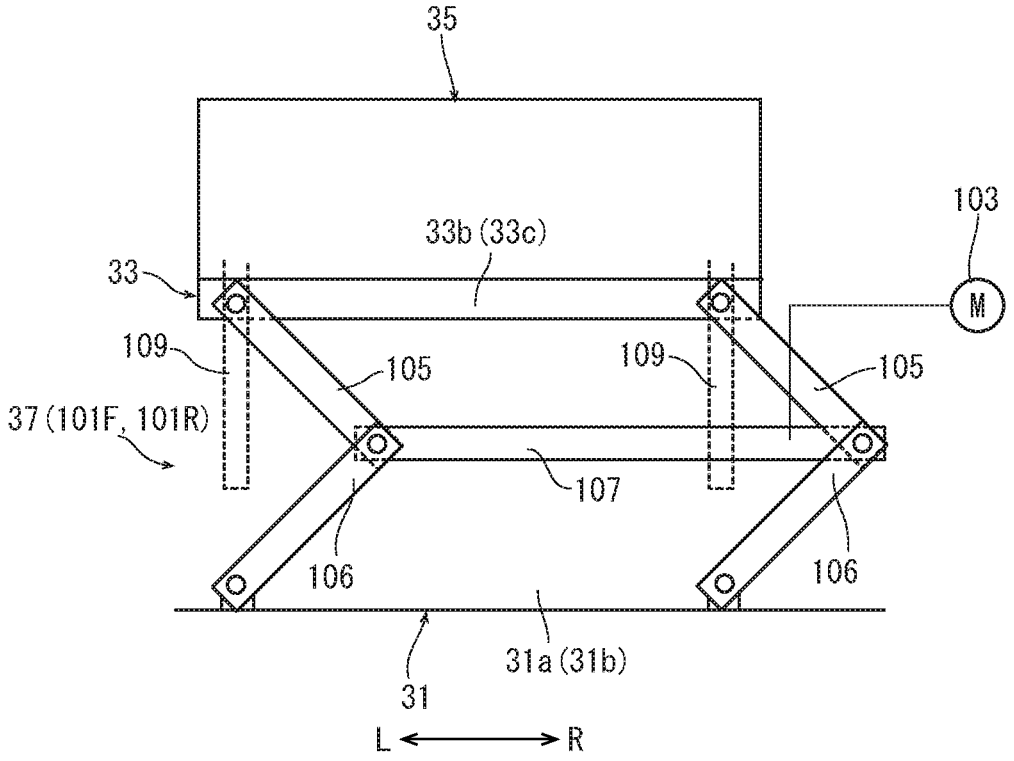
FIG. 9B is a front view schematically showing a positional relationship of each factor of the lifting and lowering mechanism of the conveyance unit assembly (when the moving unit is lifted) according to the second embodiment, in the image forming apparatus according to the embodiment of the present disclosure.

Next, with reference to FIG. 9A and FIG. 9B, a second embodiment of the conveyance unit assembly 17 will be described. FIG. 9A is a front view schematically showing a positional relationship of each factor of the lifting and lowering mechanism (when the moving unit is lowered) and FIG. 9B is a front view schematically showing a positional relationship of each factor of the lifting and lowering mechanism (when the moving unit is lifted).

The conveyance unit assembly 17 of the second embodiment has the lifting and lowering mechanism 37 different from the first embodiment.

The lifting and lowering mechanism 37 includes a pair of front and rear link mechanisms 101F and 101R and a motor 103 as a drive source to extend and contract the pair of front and rear link mechanisms 101F and 101R.

The front side link mechanism 101F includes a pair of upper arms 105, a pair of lower arms 106 and a link arm 107.

The upper arms 105 have the same length, and their upper end portions are coupled to the left and right end portions of the front standing plate 33*b* of the moving unit 33 rotatably. In addition, the upper end portions of the upper arms 105 are engaged with vertical rails 109 in a movable manner. The rails 109 are formed on the rear face of the front side plate 31*a* of the casing 31. The lower arms 106 have the same length, and their upper end portions are coupled to the lower end portions of the upper arms 105 rotatably. The lower end portions of the lower arms 106 are coupled to the lower end portion of the rear face of the front side plate 31*a* of the casing 31 rotatably.

The link arm 107 is coupled to one coupling portion of one of the upper arms 105 and one of the lower arms 106 and the other coupling portion of the other of the upper arms 105 and the other of the lower arms 106.

The rear side link mechanism 101R includes a pair of upper arms 105, a pair of lower arms 106 and a link arm 107.

The upper arms 105 have the same length, and their upper end portions are coupled to the left and right end portions of the rear standing plate 33*c* of the moving unit 33 rotatably. In addition, the upper end portions of the upper arms 105 are engaged with vertical rails 109 in a movable manner. The rails 109 are formed on the front face of the rear side plate 31*b* of the casing 31. The lower arms 106 have the same length, and their upper ends are coupled to the lower end portions of the upper arms 105 rotatably. The lower end portions of the lower arms 106 are coupled to the lower end portion of the front face of the rear side plate 31*b* of the casing 31 rotatably.

The link arm 107 is coupled to one coupling portion of one upper arm 105 and one lower arm 106 and the other coupling portion of the other upper arm 105 and the other lower arm 106.

The link arm 107 of the front side link mechanism 101F and the link arm 107 of the rear side link mechanism 101R are synchronously driven by the motor 103 to be moved upwardly and downwardly in an oblique direction while keeping the horizontal posture.

The lifting and lowering operation of the moving unit 33 by the lifting and lowering mechanism 37 will be described. As shown in FIG. 9A, when the moving unit 33 is lowered, the link arms 107 of the front and rear side link mechanisms 101F and 101R are moved downwardly, and the upper arms 105 and the lower arms 106 of the front and rear side link mechanisms 101F and 101R are turned in a direction in which they are close to each other. When the moving unit 33 is lifted, the motor 103 is driven to synchronously move the link arms 107 of the front and rear side link mechanisms 101F and 101R upwardly. Then, as shown in FIG. 9B, the upper arms 105 are moved upwardly along the rails 109 while being synchronously turned upwardly and the lower arms 106 are synchronously turned upwardly. Then, the front and rear link mechanisms 101F and 101R are extended to lift the moving unit 33. As described above, the motor 103 is driven to move the front and rear link arms 107 upwardly and downwardly, and the front and rear link mechanisms 101F and 101R are extended or contracted to lift or lower the moving unit 33.

In the second embodiment, the front and rear link mechanisms 101F and 101R are coupled to the front and rear standing plates 33*b* and 33*c* of the moving unit 33 rotatably. In a case where the front and rear link mechanisms 101F and 101R are supported to the side portions (the front and rear standing plates 33*b* and 33*c*) of the moving unit 33, compared with a case where they are supported to the lower portions (the bottom plate) of the moving unit 33, it becomes possible to decrease a height of the contracted link mechanisms 101F and 101R and to decrease a height of the casing 31. In this case, the moving unit 33 is supported at portions other than its center of gravity. However, by synchronously moving the link arms 107 of the front and rear link mechanisms 101F and 101R upwardly and downwardly, the front and rear link mechanisms 101F and 101R are extended or contracted by the same length so that it becomes possible to lift and lower the moving unit 33 while keeping the horizontal posture.

While the above description has been described with reference to the particular illustrative embodiments, the present disclosure is not limited to the above embodiments. It is to be appreciated that those skilled in the art can change or modify the embodiments without departing from the scope and spirit of the present disclosure.

The invention claimed is:

1. An image forming apparatus comprising:

a moving unit supported by a casing in an upwardly and downwardly moving manner; and a lifting and lowering mechanism configured to lift and lower the moving unit, and the lifting and lowering mechanism includes:

a fixed pulley and a winding pulley provided in the casing;

a movable pulley provided in the moving unit;

a wire configured to be wound around the fixed pulley and the movable pulley, one end of the wire being fixed to the casing and the other end of the wire being fixed to the winding pulley, a drive source configured to generate driving force;

a rack provided in the casing along an upper-and-lower direction; and a pinion provided in the moving unit and configured to be engaged with the rack, wherein when the driving force is transmitted from the drive source to the winding pulley, the winding pulley is rotated to wind and unwind the wire via the fixed pulley and the movable pulley, and the moving unit is lifted and lowered with respect to the casing while the pinion being engaged with the rack.

2. The image forming apparatus according to claim 1, wherein the moving unit and the rack are provided with an engagement pin and an engagement piece which are engaged with each other in a horizontal direction to restrict the moving unit from being displaced in the horizontal direction.

3. The image forming apparatus according to claim 1, wherein the casing includes a bottom plate, a front side plate and a rear side plate, the fixed pulley is one of a plurality of fixed pulleys provided at near left and right upper corners of the front side plate and the rear side plate, the moving unit includes a bottom plate, a front standing plate and a rear standing plate which are bent upwardly from a front edge and a rear edge of the bottom plate respectively, and the movable pulley is one of a plurality of movable pulleys provided at near left and right lower corners of the front standing plate and the rear standing plate.

4. The image forming apparatus according to claim 3, wherein the rack is one of a plurality of racks provided at left and right end portions of the front side plate and the rear side plate, and the pinion is one of a plurality of pinions provided at left and right end portions of the front standing plate and the rear standing plate.

5. An image forming apparatus comprising:

a moving unit supported by a casing in an upwardly and downwardly moving manner; and a lifting and lowering mechanism configured to lift and lower the moving unit, wherein the lifting and lowering mechanism includes:

a link mechanism provided between the moving unit and the casing; and a drive source configured to extend and contract the link mechanism, wherein the link mechanism includes:

a pair of upper arms of which upper ends are coupled to the moving unit rotatably;

a pair of lower arms, upper ends of the lower arms being coupled to lower ends of the upper arms rotatably and lower ends of the lower arms being coupled to the casing rotatably;

a link arm coupled to one coupling portion of one upper arm and one lower arm and to the other coupling portion of the other upper arm and the other lower arm; and rails configured to guide the upper ends of the upper arms along an upper-and-lower direction, wherein the link arm is driven by the drive source to be moved upwardly and downwardly, the upper arms and the lower arms are turned while the upper ends of the upper arms being moved along the rails, and the moving unit is lifted and lowered.

6. The image forming apparatus according to claim 5, wherein the moving unit has a bottom plate, a front standing plate and a rear standing plate which are bent upwardly from a front edge and a rear edge of the bottom plate respectively, the link mechanism is one of a plurality of link mechanisms provided between the front standing plate and the casing and between the rear standing plate and the casing, and the upper ends of the upper arms are coupled to left and right end portions of the front and rear standing plates rotatably.

* * * * *